US007185932B1

(12) United States Patent
Dawson

(10) Patent No.: US 7,185,932 B1
(45) Date of Patent: Mar. 6, 2007

(54) GRASPING DEVICE FOR RETRIEVING DROPPED OBJECTS

(75) Inventor: Phillip R. Dawson, Sullivan, OH (US)

(73) Assignee: Walnut Grove Hunting Products, Sullivan, OH (US)

( * ) Notice: Subject to any disclaimer, the term of this patent is extended or adjusted under 35 U.S.C. 154(b) by 0 days.

(21) Appl. No.: 11/442,064

(22) Filed: May 27, 2006

Related U.S. Application Data

(63) Continuation of application No. 11/159,906, filed on Jun. 23, 2005, now abandoned.

(51) Int. Cl.
*B66C 1/44* (2006.01)

(52) U.S. Cl. ..... 294/110.1; 294/1.1

(58) Field of Classification Search ..... 294/1.1, 294/11, 110.1, 110.2, 116, 118, 902, 81.6, 294/81.61, 81.62, 82.11, 19.3; 43/17.2, 89, 43/5, 6, 53.5; 273/447, 448
See application file for complete search history.

(56) References Cited

U.S. PATENT DOCUMENTS 877,389 A * 1/1908 Werd ..... 294/115
976,789 A * 11/1910 Drubko ..... 43/89
1,534,954 A * 4/1925 Holtz ..... 294/19.3
2,579,812 A * 12/1951 Fisher et al. ..... 294/19.3
3,669,427 A * 6/1972 Curtis ..... 294/19.2
6,361,094 B1 * 3/2002 Pelley ..... 294/19.2

* cited by examiner

*Primary Examiner*—Eileen D. Lillis
*Assistant Examiner*—Paul T. Chin
(74) *Attorney, Agent, or Firm*—The Kline Law Firm

(57) ABSTRACT

A mechanical grasping device for retrieving dropped objects includes a pair of opposing claws and an extension element. The extension element may be either rigid or flexible, and is typically a rope or cord. A trigger plate is positioned between the two claws, and is spring loaded to transmit tension to the claws when the device is in the open position. A pair of protruding tabs at the end of the arms of the trigger plate are received in locking holes in the claws in an open position. When the triggering mechanism is released, the spring tension urges the claws together so that interlocking fingers on the ends of the claws mesh together in a closed position. The object to be retrieved is secured in the grasping device, and the user pulls the object to him using the extension element.

3 Claims, 4 Drawing Sheets

GRASPING DEVICE FOR RETRIEVING DROPPED OBJECTS

This application is a continuation of U.S. application Ser. No. 11/159,906, filed Jun. 23, 2005 now abandoned.

BACKGROUND OF THE INVENTION

1. Field of the Invention

The present invention relates generally to a mechanical device to pick up objects, and more particularly is an extendable device to pick up objects that have been dropped.

2. Description of the Prior Art

Retrieving objects that have fallen to the ground or floor can sometimes be a difficult task. While young, healthy people can easily accomplish the task of bending over to pick up an object, for older people or the infirm, retrieving a dropped object can be a difficult or impossible task. For instance, a person in a wheelchair cannot possibly retrieve any object that they may drop. Even for able-bodied people, special circumstances can make picking up things very difficult. Workers on ladders or scaffolds dread having to climb down to retrieve objects once they have reached their elevated destination. Similarly, a hunter in a tree stand does not want to abandon his post to retrieve a dropped object.

Accordingly, it is an object of the present invention to provide a device that enables a person to greatly extend his reach to pick up an item.

It is another object of the present invention to provide a device that can be released if it affixes itself to an unintended target.

It is still another object of the present invention to provide a device that is simple and inexpensive to manufacture.

SUMMARY OF THE INVENTION

The present invention is a mechanical grasping device for retrieving dropped objects. The device comprises a pair of opposing claws and an extension element. The extension element may be either rigid or flexible, and is typically a rope or cord. A trigger plate is positioned between the two claws, and is spring loaded to transmit tension to the claws when the device is in the open position. A pair of protruding tabs at the ends of the arms of the trigger plate are received in locking holes in the claws in an open position. When the triggering mechanism is released, the spring tension urges the claws together so that interlocking fingers on the ends of the claws mesh together in a closed position. The object to be retrieved is secured in the grasping device, and the user pulls the object to him using the extension element.

An advantage of the present invention is that the user can retrieve objects from an elevated position without leaving the elevated position.

Another advantage of the present invention is that the extension element can be made to be any length desired.

A still further advantage of the present invention is that the device is simple and inexpensive to manufacture.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
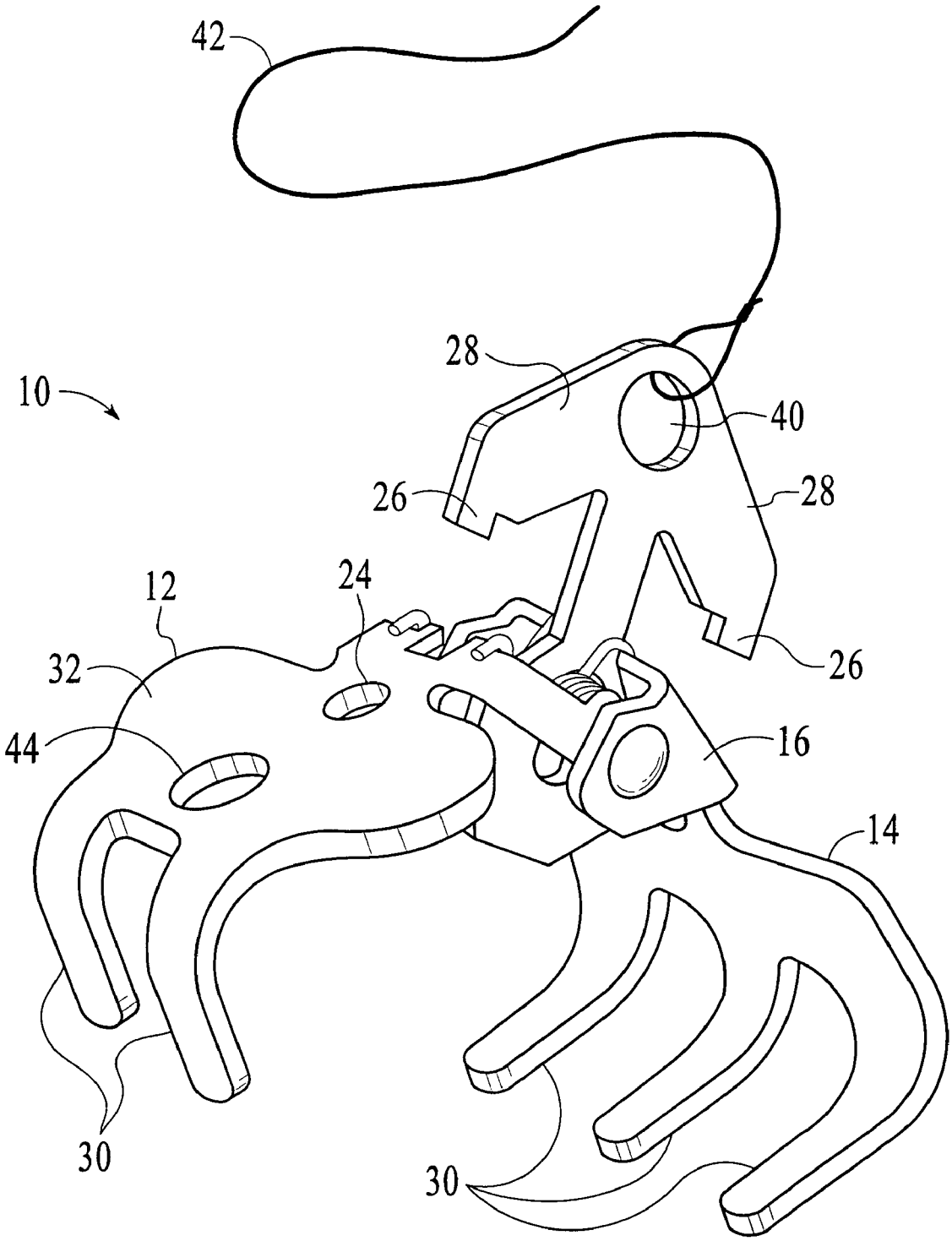
FIG. 1 is a perspective view of the grasping device of the present invention immediately following actuation of the triggering mechanism.
Figure 2:
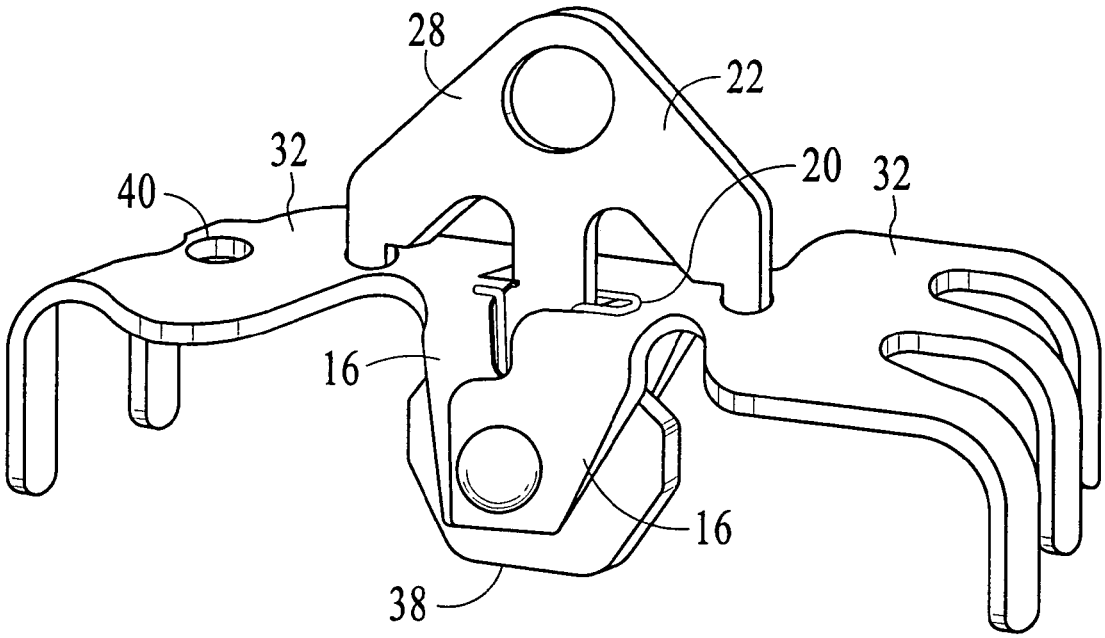
FIG. 2 is a top perspective view of the grasping device in the open position.
Figure 3:
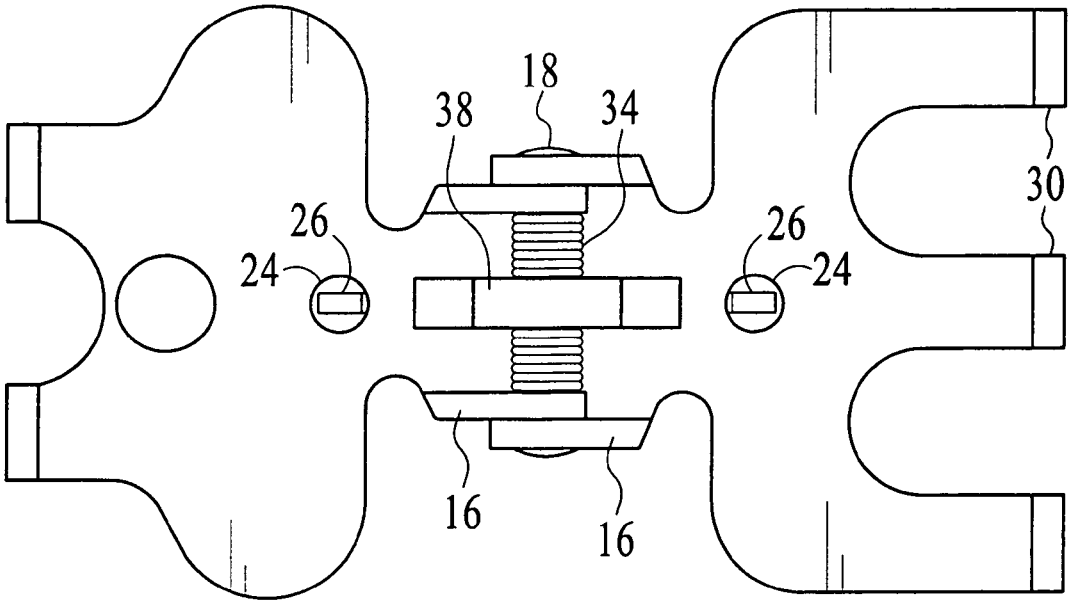
FIG. 3 is a bottom view of the grasping device in the open position.

The present invention is a mechanical grasping device 10 adapted for retrieving dropped objects. The device 10 comprises a pair of opposing claws, a first claw 12 and a second claw 14. Each claw 12, 14 comprises at least one pivot ear 16, with a through hole therein. The through hole in the pivot ear 16 allows the claws 12, 14 to be mounted on a pivot axle 18. In the preferred embodiment, a pair of pivot ears 16 are utilized, with an opening 20 in a central area to accommodate a trigger plate 22.

A locking hole 24 is located in a neck area of each of the claws 12,14. The locking holes 24 receive protruding tabs 26 extending from each arm 28 of the trigger plate 22. At the end of each of the arms 28 is at least one grasping finger 30. In the preferred embodiment, the grasping fingers 30 extend downward at a 90° angle from the body 32 of the claws 12, 14. In the preferred embodiment, the first claw 12 comprises an even number of fingers (two), while the second claw comprises an odd number of fingers (three). Clearly, any number of fingers 30 can be utilized on either claw 12, 14. The critical factor for the fingers 30 is that they be brought into opposition when the device 10 is released to the closed position. In the preferred embodiment, the fingers 30 of the first claw 12, intermesh with the fingers 30 of the second claw 14 when small objects are being grasped, ensuring that no object will slip through the fingers 30 of the device 10.

Figure 4:
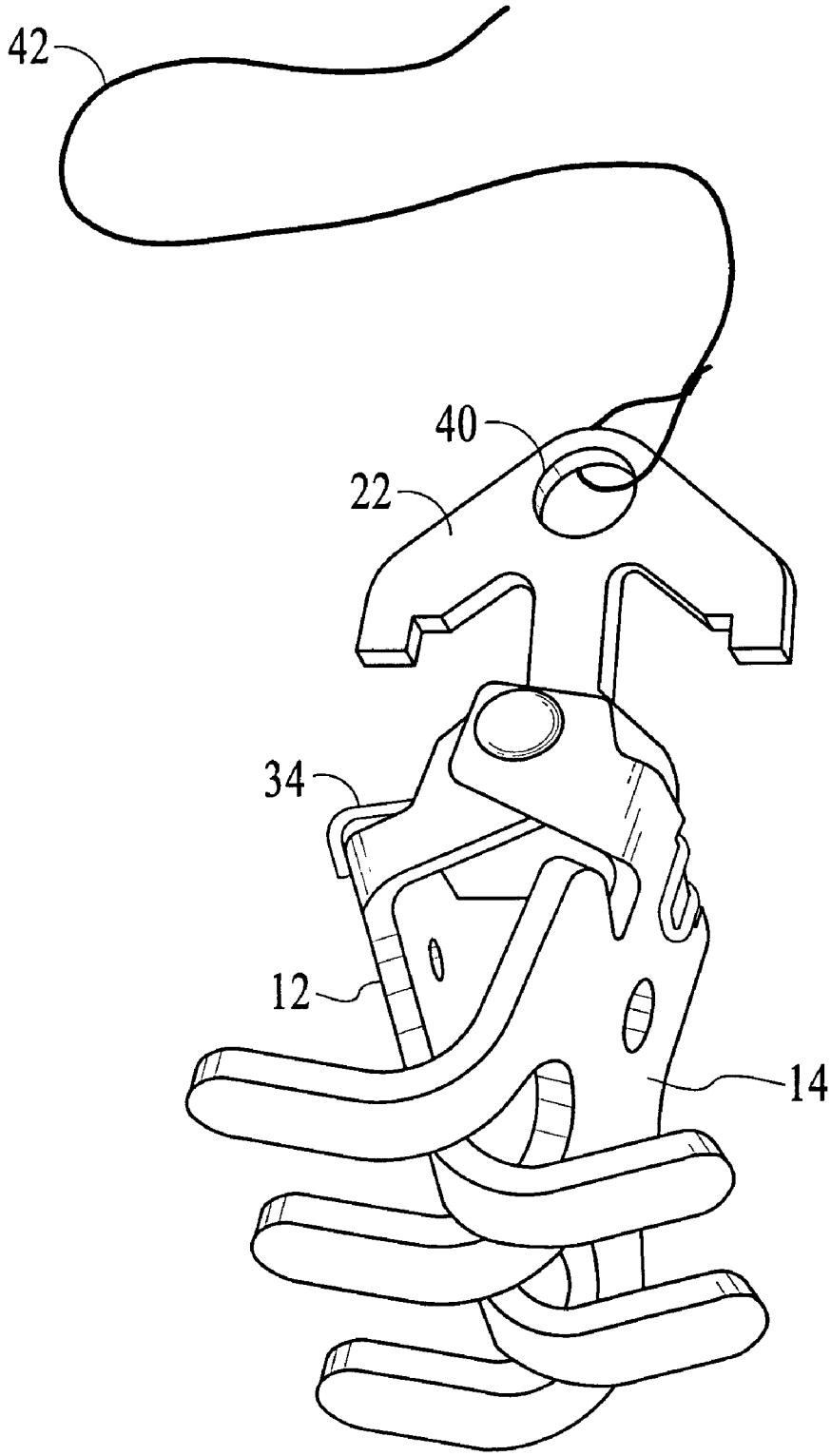
FIG. 4 is a perspective view of the grasping device in the closed position.
Figure 5:
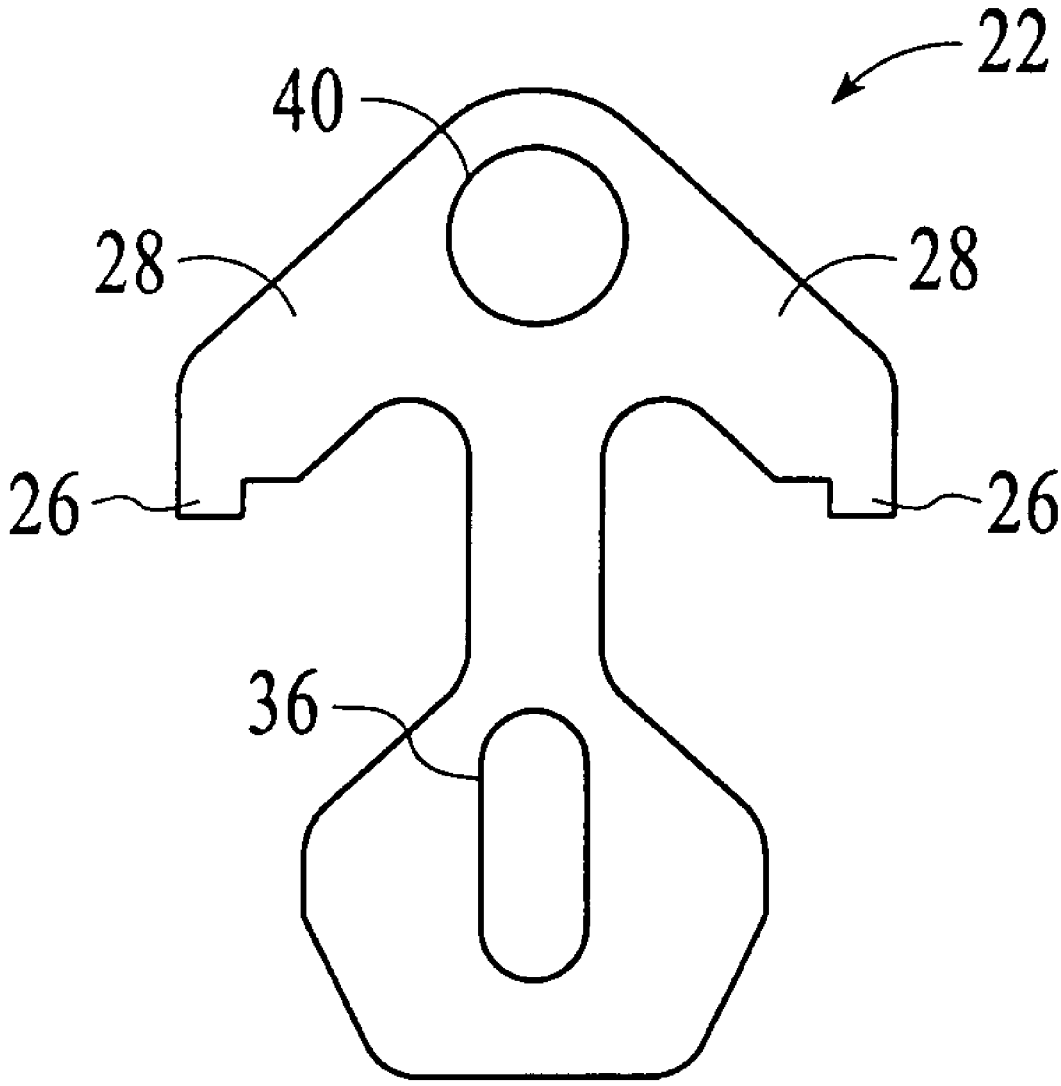
FIG. 5 is a detail view of the trigger plate.

A spring element 32 is mounted on the pivot axle 18 in contact with both of the claws 12, 14. The spring element 32 urges the claws 12, 14 toward the closed position shown in FIG. 4. While a helical spring is utilized in the preferred embodiment, it should be clear to those skilled in the art that many different springs, metal strips, etc. can be used to provide the tension required to urge the claws toward the closed position for the proper function of the present invention.

The trigger plate 22 includes at an inner end a mounting slot 36 that receives the pivot axle 18. The mounting slot 36 allows the trigger plate to move up and down relative to the pivot axle 18. A trigger point 38 at a lower end of the trigger plate 32 is the element that contacts the object to be picked up when the device 10 is being actuated.

The trigger plate 22 further includes an extension element receiving means 40 that receives an extension element 42. The extension element 42 allows the user to increase his effective reach by a length of his choosing. In the preferred embodiment, the extension element 42 is a rope or a cord.

In addition, a lighting element can be mounted in a light receiving hole 44 provided in one or both of the claws 12, 14. The optional lighting element is useful in nighttime applications.

Operation of the mechanical grasping device 10 is very simple in whatever application it is used. Inasmuch as the device was designed as an aid to hunters, that particular application will be used to describe the operation of the device. The user (hunter) takes the grasping device 10 with him to his elevated position such as a tree stand. When he drops something from the stand, (knife, flashlight, lunch or the like), the hunter lowers the grasping device 10 with the rope 42. He positions the device 10 over the dropped item, and then bounces the trigger point 38 of the trigger 22 on the item. The upward motion of the trigger plate 22 causes the tabs 26 to be lifted out of the locking holes 24. This releases the claws 12, 14 from the open position, so that the tension of the spring 34 causes the claws 12, 14 to close around the dropped object. The hunter then pulls the device up with the rope 42, and the object is retrieved without the hunter having to climb down from the stand.

The operation of the device is equivalent in all applications, but the user may sometimes choose to have a rigid extension element 42. A wheelchair user for instance may choose to have the grasping device mounted on a rigid handle, in which case the rigid handle serves as the extension element 42.

The above disclosure is not intended as limiting. Those skilled in the art will recognize that numerous modifications and alterations may be made while retaining the teachings of the invention. Accordingly, the above disclosure should be construed as limited only by the restrictions of the appended claims.

I claim:

1. A grasping device comprising:

a first claw comprising at least one grasping finger, a second claw comprising at least one grasping finger, said second claw being mounted in opposition to said first claw, a triggering element comprising a trigger point, and a means for providing tension that urges said first and second claws toward a closed position; wherein said grasping device includes means for locking said first claw and said second claw in an open position wherein said grasping fingers of said first claw are separated from said grasping fingers of said second claw, said means for locking comprises a pair of protruding tabs on said triggering element that are received in receiving holes in said first and said second claws, and when said trigger point is brought into contact with an object to be grasped, said triggering element releases said means for locking by moving said protruding tabs out of said receiving holes in said first and said second claws, thereby releasing said first and said second claws so that said first and said second claws are urged by said means for providing tension from said open position toward a closed position, in which said at least one grasping finger of said first claw overlaps said at least one grasping finger of said second claw, said first and said second claws thereby enclosing the object to be grasped.

2. The device of claim 1 wherein:

said device comprises an extension element to increase an effective range of said device.

3. A grasping device comprising:

a first claw comprising at least one grasping finger, a second claw comprising at least one grasping finger, said second claw being mounted in opposition to said first claw, a triggering element comprising a trigger point, a means for providing tension that urges said first and second claws toward a closed position, and an extension element to increase an effective range of said device; wherein said grasping device includes means for locking said first claw and said second claw in an open position wherein said grasping fingers of said first claw are separated from said grasping fingers of said second claw, said means for locking comprises a pair of protruding tabs on said triggering element that are received in receiving holes in said first and said second claws, and when said trigger point is brought into contact with an object to be grasped, said triggering element releases said means for locking by moving said protruding tabs out of said receiving holes in said first and said second claws, thereby releasing said first and said second claws so that said first and said second claws are urged by said means for providing tension from said open position toward a closed position, in which said at least one grasping finger of said first claw overlaps said at least one grasping finger of said second claw, said first and said second claws thereby enclosing the object to be grasped.

* * * * *